US010731924B2

(12) United States Patent
Huang

(10) Patent No.: US 10,731,924 B2
(45) Date of Patent: Aug. 4, 2020

(54) VAPOR CHAMBER SEALING METHOD AND STRUCTRE USING THE SAME

(71) Applicant: Kunshan Jue-Chung Electronics Co., Ltd., Kunshan, Jiangsu (CN)

(72) Inventor: Yu-Po Huang, Kunshan (CN)

(73) Assignee: KUNSHAN JUE-CHUNG ELECTRONICS CO., LTD., Kunshan, Jiangsu (CN)

( * ) Notice: Subject to any disclaimer, the term of this patent is extended or adjusted under 35 U.S.C. 154(b) by 84 days.

(21) Appl. No.: 16/205,163

(22) Filed: Nov. 29, 2018

(65) Prior Publication Data

US 2020/0173732 A1 Jun. 4, 2020

(51) Int. Cl.
*F28D 15/00* (2006.01)
*F28D 15/04* (2006.01)
*F28D 15/02* (2006.01)

(52) U.S. Cl.
CPC ..... *F28D 15/043* (2013.01); *F28D 15/0283* (2013.01)

(58) Field of Classification Search
CPC ..... F28D 15/043; F28D 15/0283
USPC ..... 165/104.26
See application file for complete search history.

(56) References Cited

U.S. PATENT DOCUMENTS

2003/0052050 A1* 3/2003 Vigna ..... B01D 63/084 210/321.84
2010/0326629 A1* 12/2010 Meyer, IV ..... F28D 15/04 165/104.26
2015/0168078 A1* 6/2015 Yang ..... F28D 15/04 165/104.26
2015/0208549 A1* 7/2015 Shedd ..... F28D 15/00 165/104.27
2016/0109912 A1* 4/2016 Shen ..... G06F 1/203 361/679.54
2017/0067696 A1* 3/2017 Chin ..... H01L 23/427

* cited by examiner

*Primary Examiner* — Davis D Hwu
(74) *Attorney, Agent, or Firm* — Chun-Ming Shih; HDLS IPR Services

(57) ABSTRACT

Disclosed are a vapor chamber sealing method and a structure using the method. An upper plate and a lower plate used for making a plate of a vapor chamber are prepared, and outer edges of the upper and lower plates are formed into mutually attached sealed edges, and then the sealed edges of the upper and lower plates are aligned and engaged with each other to form a chamber between the upper and lower plates, and a sealing structure is formed and combined with the sealed edges of the upper and lower plates by an injection molding method, and the sealing structure is formed around and combined with the sealed edges of the upper and lower plates.

9 Claims, 5 Drawing Sheets

VAPOR CHAMBER SEALING METHOD AND STRUCTRE USING THE SAME

FIELD OF THE INVENTION

The technical field of this disclosure relates to a flat plate heat pipe, and more particularly to a vapor chamber sealing method and its structure.

BACKGROUND OF THE INVENTION

A vapor chamber, also known as a heat conducting plate or a flat plate heat pipe, has functions and operating principle similar to those of heat pipes, and all of the devices have a working fluid sealed into a pipe or plate type chamber and provided for actuating an evaporation-condensation cycle to achieve the effects of a quick heat transfer and a uniform temperature. The vapor chamber has been widely used in various fields of heat dissipation.

However, the conventional vapor chamber is usually formed on a shell or a plate and mainly comprised of two plates engaged with each other, so that it is necessary to stack the two plates and seal their peripheries by a process such as high temperature sintering or laser welding, but the high temperature of the aforementioned process may cause a deterioration of the metal of the vapor chamber or plates and affect the strength or hardness of the structure of the shell or plate.

Regardless of how we control the temperature or select an appropriate metal, it is still inevitable to affect the appearance of the shell or plate structure of the vapor chamber.

In view of the aforementioned drawbacks of the conventional vapor chamber, the discloser of this disclosure based on years of experience in the related industry to conduct extensive research and experiment, and finally provided an innovative vapor chamber sealing method and its structure to overcome the drawbacks of the prior art.

SUMMARY OF THE INVENTION

Therefore, it is a primary objective of this disclosure to overcome the drawbacks of the prior art by providing a vapor chamber sealing method and its structure, and both of the method and structure can achieve the effects of sealing the edges of the vapor chamber while maintaining the strength of the metal of the structure of the plate or shell of the vapor chamber.

To achieve the aforementioned and other objectives, this disclosure provides a vapor chamber sealing method, comprising the steps of:

(S1) preparing an upper plate and a lower plate for forming a vapor chamber plate, and the outer edges of both upper and lower plates are sealed edges attached on each other;

(S2) aligning the sealed edges of the upper and lower plates precisely, and engaging the upper and lower plates to form a chamber between the upper and lower plates; and (S3) forming a sealing structure combined with the sealed edges of the upper and lower plates by injection molding method.

To achieve the aforementioned and other objectives, this disclosure also provides a vapor chamber sealing structure comprising an upper plate, a lower plate, and a sealing structure, characterized in that the upper plate has a continuous surrounding sealed edge formed at the outer edge of the upper plate, and the lower plate outer edge also has a continuous surrounding sealed edge, and the sealed edge of the lower plate is aligned precisely and engaged with each other to form a chamber between the upper and lower plates, and the sealing structure is formed by injection molding and continuously surrounds and combines with the sealed edges of the upper and lower plates.

DESCRIPTION OF THE PREFERRED EMBODIMENTS

Figure 1:
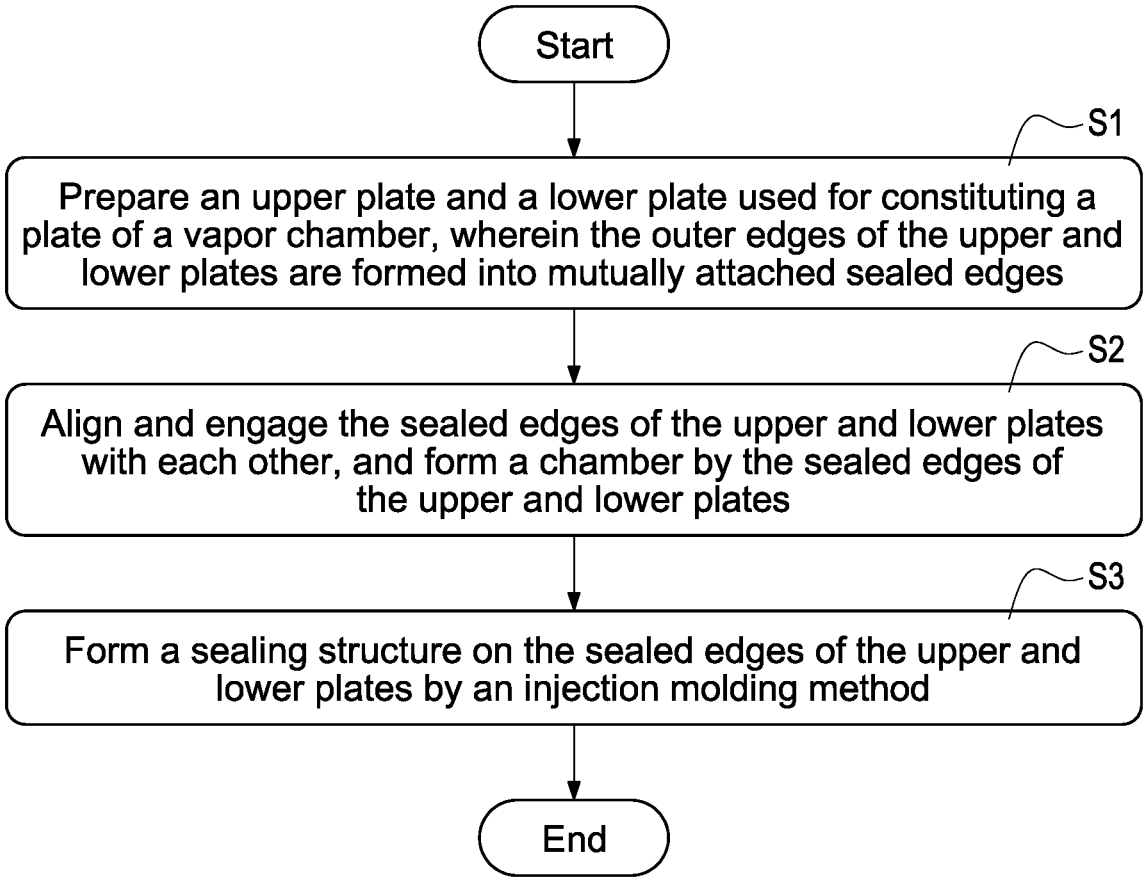
FIG. 1 is a flow chart of a vapor chamber sealing method of this disclosure.

The technical contents of this disclosure will become apparent with the detailed description of preferred embodiments accompanied with the illustration of related drawings as follows. It is noteworthy that same numerals are used for representing same respective elements in the drawings.

With reference to FIG. 1 for a flow chart of a vapor chamber sealing method of this disclosure, this disclosure provides a vapor chamber sealing method and its structure capable of sealing the edges of the vapor chamber without requiring the manufacturing process such as high-temperature sintering or laser welding, so as to avoid the issues of deteriorating the metal of the vapor chamber by high temperature and affecting the structural strength or hardness of the vapor chamber.

Figure 2:
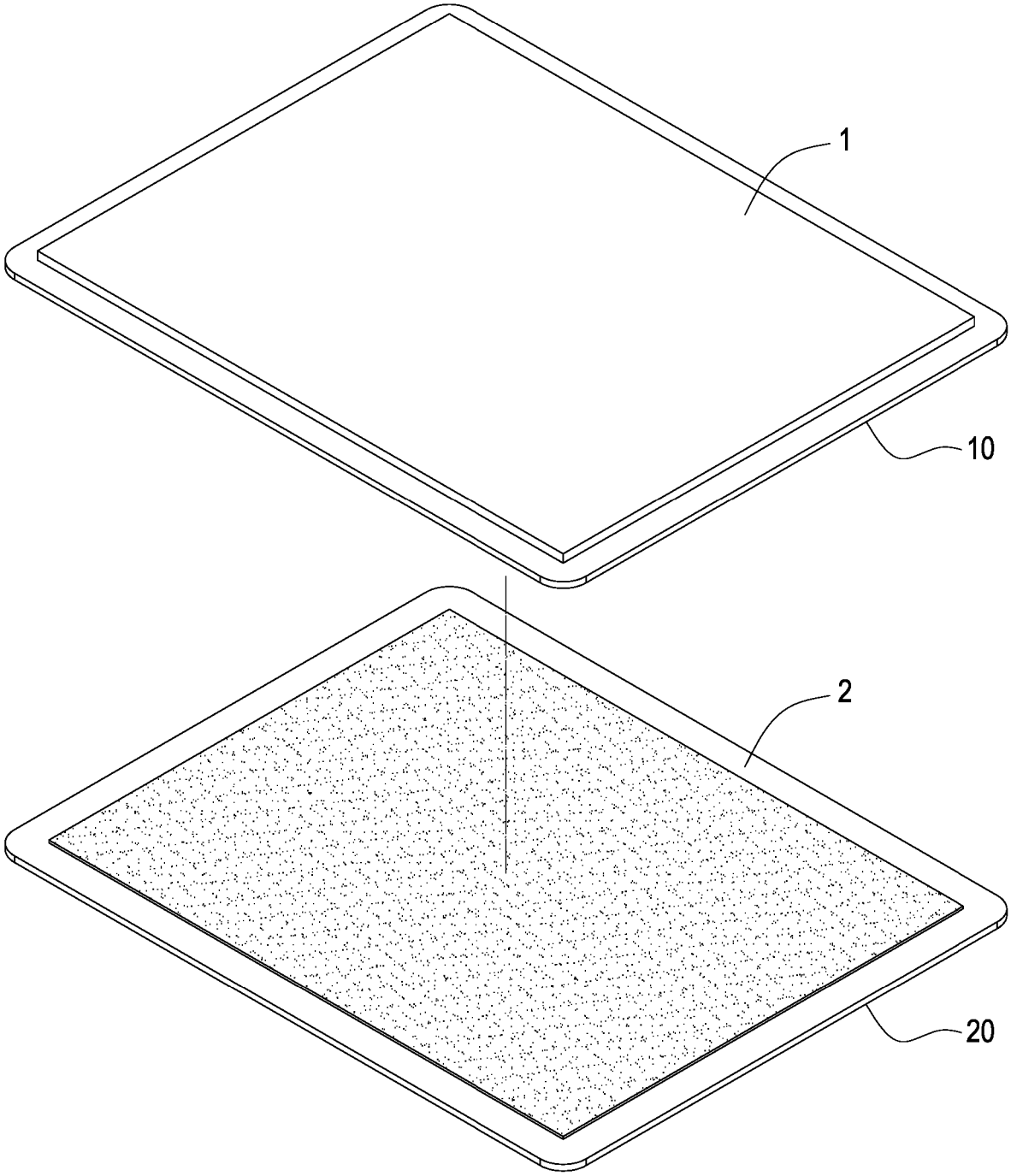
FIG. 2 is an exploded view of a vapor chamber of this disclosure before the vapor chamber is sealed.

With reference to FIG. 2 and Step S1 of FIG. 1, an upper plate 1 and a lower plate 2 used for forming a plate of a vapor chamber are prepared, wherein the upper plate 1 has a sealed edge 10 formed at and continuously surrounding the outer edge of the upper plate 1, and the lower plate 2 also has a sealed edge 20 formed at and continuously surrounding the outer edge of the lower plate 2. When the upper and lower plates 1, 2 are engaged with each other, the sealed edge 10 of the upper plate 1 and the sealed edge 20 of the lower plate 2 are aligned and attached with each other.

Figure 3:
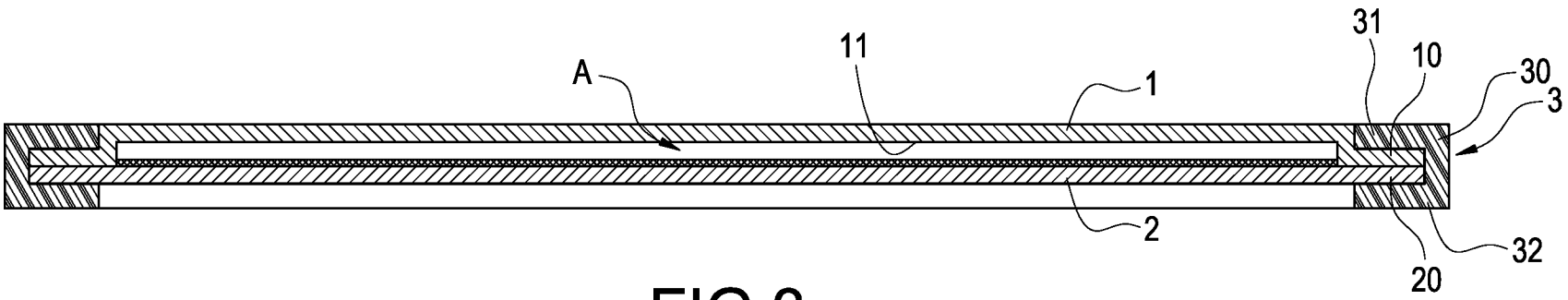
FIG. 3 is a cross-sectional view of a vapor chamber sealing structure of this disclosure.

With reference to FIG. 3 and Step S2 of FIG. 1, the sealed edges 10, 20 of the upper and lower plates 1, 2 are aligned and engaged with each other to form a chamber A between the upper and lower plates 1, 2. In this embodiment, the upper plate 1 has a recess 11 concavely formed thereon and configured to be opposite to the lower plate 2, and the lower plate 2 is substantially in a tabular shape, and the lower plate 2 has a capillary tissue disposed thereon, wherein the upper and lower plates 1, 2 are engaged with each other to form the chamber A by the recess 11.

With reference to FIG. 3 and Step S3 of FIG. 1, a sealing structure 3 is formed at and combined with the sealed edges 10, 20 of the upper and lower plates 1, 2 by an injection molding method such as plastic injection molding or metal powder injection molding. The sealing structure 3 may be a frame made of plastic or metal powder and continuously surrounding around the sealed edges 10, 20 of the upper and lower plates 1, 2. The sealing structure includes an outer edge 30, an upper sealing edge 31 extended from the upper end of the outer edge 30 to the sealed edge 10 of the upper plate 1, and a lower sealing edge 32 extended from the lower end of the outer edge 30 to the sealed edge 20 of the lower plate 2. The sealing structure 3 comes with a U-shaped cross-section with an opening facing the sealed edges 10, 20 and provided for clamping the sealed edges 10, 20 of the upper and lower plates 1, 2 closely to achieve the sealing effect of the vapor chamber, while maintaining the metal strength of the plate and shell.

Specifically, the outer surfaces of the upper and lower plates 1, 2 are processed with a surface treatment in this disclosure. For example, a sealing structure 3 is formed at the outer surfaces of the sealed edges 10, 20 of the upper and lower plates 1, 2 separately by the aforementioned injection molding method, so that the sealing structure 3 is capable of improving the binding or combining strength between the upper and lower plates 1, 2.

With the aforementioned structural assembly, the vapor chamber sealing method and its structure in accordance with this disclosure are achieved.

Figure 4:
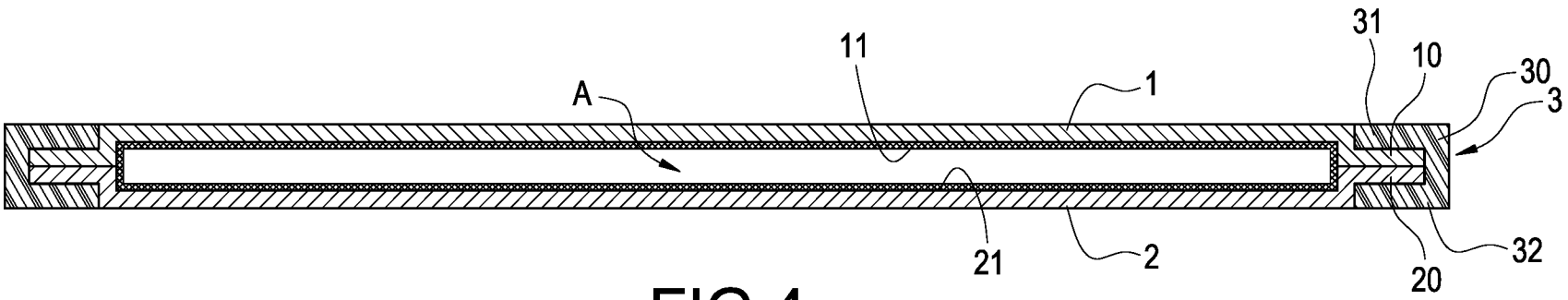
FIG. 4 is a cross-sectional view of a vapor chamber sealing structure in accordance with another embodiment of this disclosure.

With reference to FIG. 4 for a cross-sectional view of a sealing structure of a vapor chamber in accordance with another embodiment of this disclosure, the lower plate 2 has a recess 21 concavely formed thereon and configured to be opposite to the upper plate 1, and the upper and lower plates 1, 2 have a capillary tissue disposed therein. The upper and lower plates 1, 2 are engaged with each other to form the chamber A by the recesses 11, 21. Since the upper and lower plates 1, 2 have the recesses 11, 21, therefore the lower sealing edges 31, 32 and the outer edges of the outer surfaces of the upper and lower plates 1, 2 constitute a smooth flat surface after the sealing structure 3 surrounds the sealed edges 10, 20.

Figure 5:
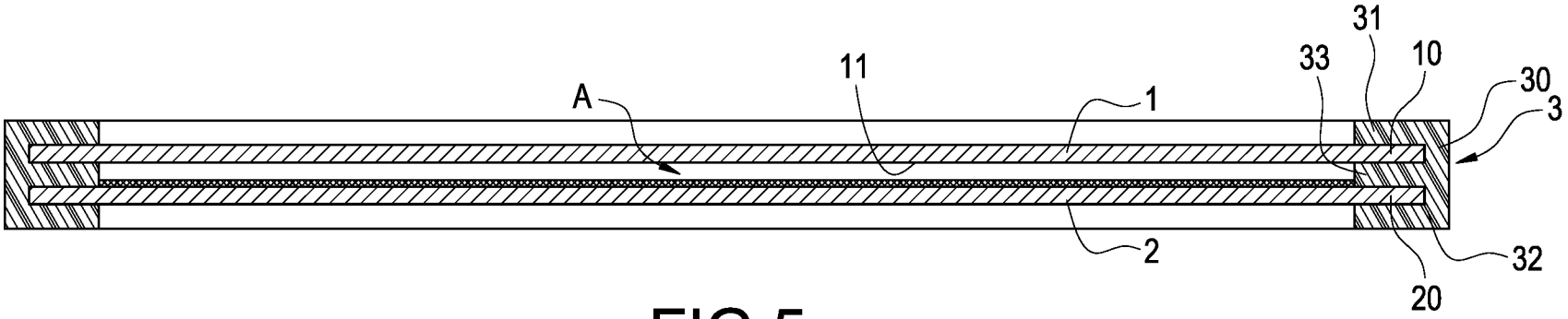
FIG. 5 is a cross-sectional view of a vapor chamber sealing structure in accordance with a further embodiment of this disclosure.

With reference to FIG. 5 for a cross-sectional view of a sealing structure of a vapor chamber in accordance with a further embodiment of this disclosure, the upper and lower plates 1, 2 are substantially in a tubular shape, but there is an interval existing between the upper and lower plates 1, 2 when they are engaged with each other. With the formation of the sealing structure 3, an edge-partition 33 is formed between the sealed edges 10, 20 of the upper and lower plates 1, 2, and the edge-partition 33 maintains the interval between the upper and lower plates 1, 2 to form the chamber A. As a result, the process of stamping the plate to form the aforementioned recess 11 or 21 can be skipped.

In the vapor chamber sealing method and its structure in accordance with this disclosure, the sealed edges of the upper and lower plates 1, 2 of the vapor chambers are formed by the injection molding method to provide the sealing structure 3 which surrounds the outer edge of the vapor chamber, so as to achieve the sealing effect of the vapor chamber. With the sealed edges of the vapor chamber, the metal of the vapor chamber can be prevented from being deteriorated by the high temperature of the conventional high-temperature sintering or laser welding or affecting the strength or hardness of the structure.

In summation of the description above, this disclosure is definitely capable of achieving the expected effects and overcoming the drawbacks of the prior art, and the disclosure complies with patent application requirements, and thus is duly filed for patent application. While this disclosure has been described by means of specific embodiments, numerous modifications and variations could be made thereto by those skilled in the art without departing from the scope and spirit of this disclosure set forth in the claims.

What is claimed is:

1. A vapor chamber sealing method, comprising the steps of:

(a) preparing an upper plate and a lower plate used for constituting a plate of a vapor chamber, wherein outer edges of the upper and lower plates are formed into mutually attached sealed edges;

(b) aligning and engaging the sealed edges of the upper and lower plates with each other, and forming a chamber by the sealed edges of the upper and lower plates; and (c) forming a sealing structure on the sealed edges of the upper and lower plates by an injection molding method, wherein the upper plate has a recess concavely formed thereon and configured to be opposite to the lower plate in the step (b), so that the upper and lower plates can be engaged with each other to form the chamber by the recess.

2. The vapor chamber sealing method of claim 1, wherein the lower plate also has a recess concavely formed thereon and configured to be opposite to the upper plate, so that the upper and lower plates can be engaged with each other to form the chamber by the two recesses.

3. The vapor chamber sealing method of claim 1, wherein the chamber has a capillary tissue installed therein.

4. The vapor chamber sealing method of claim 1, wherein the injection molding method in the step (c) is a plastic injection molding or a metal powder injection molding.

5. The vapor chamber sealing method of claim 1, wherein the outer surface of the upper and lower plates is processed with a surface treatment before the step (c) takes place.

6. A vapor chamber sealing structure, comprising:

an upper plate, with a sealed edge formed at the outer edge thereof and continuously surrounding the upper plate;

a lower plate, with a sealed edge formed at the outer edge thereof and continuously surrounding the lower plate, and the sealed edge of the lower plate and the sealed edge of the upper plate being aligned and engaged with each other to form a chamber between the upper and lower plates; and a sealing structure, continuously surrounding and combined with the sealed edges of the upper and lower plates by an injection molding method, wherein the upper plate has a recess concavely formed thereon and configured to be opposite to the lower plate to form the chamber.

7. The vapor chamber sealing structure of claim 6, wherein the lower plate also has a recess concavely formed thereon and configured to be opposite to the upper plate to form the chamber by the recesses of the upper and lower plates.

8. A vapor chamber sealing structure, comprising:

an upper plate, with a sealed edge formed at the outer edge thereof and continuously surrounding the upper plate;

a lower plate, with a sealed edge formed at the outer edge thereof and continuously surrounding the lower plate, and the sealed edge of the lower plate and the sealed edge of the upper plate being aligned and engaged with each other to form a chamber between the upper and lower plates; and a sealing structure, continuously surrounding and combined with the sealed edges of the upper and lower plates by an injection molding method, wherein the sealing structure includes an outer edge, an upper sealing edge extended from the upper end of the outer edge to the sealed edge of the upper plate, and a lower sealing edge extended from the lower end of the outer edge to the sealed edge of the lower plate.

9. The vapor chamber sealing structure of claim 6, wherein the upper and lower plates are substantially in a tabular shape, and the sealing structure has an edge-partition disposed between the upper and lower plates.

* * * * *